US006901886B2

(12) United States Patent
Lesage

(10) Patent No.: US 6,901,886 B2
(45) Date of Patent: Jun. 7, 2005

(54) SECONDARY BURNER FOR SEALED COMBUSTION CHAMBER OF A GAS-FIRED HOT WATER HEATER

(76) Inventor: Claude Lesage, 215 Lakeshore, Pointe Claire, Quebec (CA), H3S 4K2

( * ) Notice: Subject to any disclaimer, the term of this patent is extended or adjusted under 35 U.S.C. 154(b) by 24 days.

(21) Appl. No.: 10/699,692

(22) Filed: Nov. 4, 2003

(65) Prior Publication Data

US 2005/0092262 A1 May 5, 2005

(51) Int. Cl.[7] ..... F22B 5/04
(52) U.S. Cl. ..... 122/14.31; 122/20 R
(58) Field of Search ..... 122/14.31, 20 R, 122/14.2, 17.1

(56) References Cited

U.S. PATENT DOCUMENTS 6,003,477 A * 12/1999 Valcic ..... 122/14.21
6,109,216 A * 8/2000 Reynolds et al. ..... 122/13.01
6,338,319 B1 * 1/2002 Vago ..... 122/13.01
6,422,178 B1 * 7/2002 Lannes et al. ..... 122/14.31
6,435,140 B1 * 8/2002 Joyce ..... 122/13.01

* cited by examiner

*Primary Examiner*—Gregory A. Wilson
(74) *Attorney, Agent, or Firm*—Ogilvy Renault; Guy J. Houle

(57) ABSTRACT

A secondary burner is provided in a sealed combustion chamber of a gas-fired hot water heater. The hot water heater has a support base for supporting it elevated from a floor surface. The sealed combustion chamber is supported over the base under an inner casing of the hot water heater which is adapted to contain water to be heated by a primary burner in the combustion chamber. An air inlet port is provided in the bottom wall of the combustion chamber to supply combustion air to the primary burner. The secondary gas burner perforated disc is secured entirely across the air inlet port and in direct unobstructed communication with the primary burner. The secondary gas burner perforated disc has holes throughout its inner surface whereby to ignite its an inner surface thereof in the presence of flammable vapors and air entering the gas burner perforated disc from an outer surface thereof. The support base has air inlet openings to permit ambient air supply to the outer surface.

10 Claims, 2 Drawing Sheets

SECONDARY BURNER FOR SEALED COMBUSTION CHAMBER OF A GAS-FIRED HOT WATER HEATER

TECHNICAL FIELD

The present invention relates to a secondary burner for a sealed combustion chamber of a gas-fired hot water heater and located in an unobstructed manner directly under a primary burner.

BACKGROUND ART

There is a need to provide a gas-fired hot water heater with explosion proof protection in the event that flammable vapors, propagating on a floor surface on which the hot water heater is supported, reach the combustion chamber and ignite the vapors causing explosion. In my U.S. application Ser. No. 10/234,140 filed on Sep. 5, 2002 and entitled "EXPLOSION PROOF GAS-FIRED WATER HEATER", there is described a gas-fired heater with a sealed combustion chamber and wherein combustion air is supplied to the combustion chamber through a vertical duct which is in sealed communication with the combustion chamber and which has an elevated air inlet opening located well above the support surface of the hot water heater. A flammable gas vapor detector is associated with that hot water heater whereby to detect flammable vapors close to the floor area of the hot water heater and to shut off the supply of gas to the burner and pilot well in advance of the flammable gas vapors rising to the inlet port of the duct. It is also known to support a gas water heater on a support base to elevate the combustion chamber at least eighteen inches above the support floor. It is also known to provide flame arrestors in the bottom wall of a combustion chamber to resist to flammable vapors. These structures require reconfiguring the bottom wall of the combustion chamber, see U.S. Pat. No. 6,295,952 issued on Oct. 2, 2001.

SUMMARY OF INVENTION

It is a feature of the present invention to provide an explosion proof gas-fired hot water heater and wherein a secondary burner is secured to the combustion chamber bottom wall and located under a primary burner and in direct unobstructed communication therewith whereby the primary burner will ignite the secondary burner when flammable vapors enter the combustion chamber through the secondary burner, the secondary burner being a perforated disc burner.

According to a broad aspect of the present invention there is therefore provided a secondary burner in a sealed combustion chamber of a gas-fired hot water heater. The hot water heater has a support base for supporting it elevated from a floor surface. The sealed combustion chamber is supported over the base under an inner casing of the hot water heater which is adapted to contain water to be heated by a primary burner in the combustion chamber. An air inlet port is provided in the bottom wall of the combustion chamber to supply combustion air to the primary burner. The secondary gas burner is a perforated disc secured entirely across the air inlet port and in direct communication with the primary burner. The secondary gas burner perforated disc has holes throughout its inner surfaces whereby to ignite on the inner surface thereof in the presence of flammable vapors and air entering the gas burner perforated disc from an outer surface thereof. The support base has air inlet openings to permit ambient air supply to the outer surface of the perforated disc.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
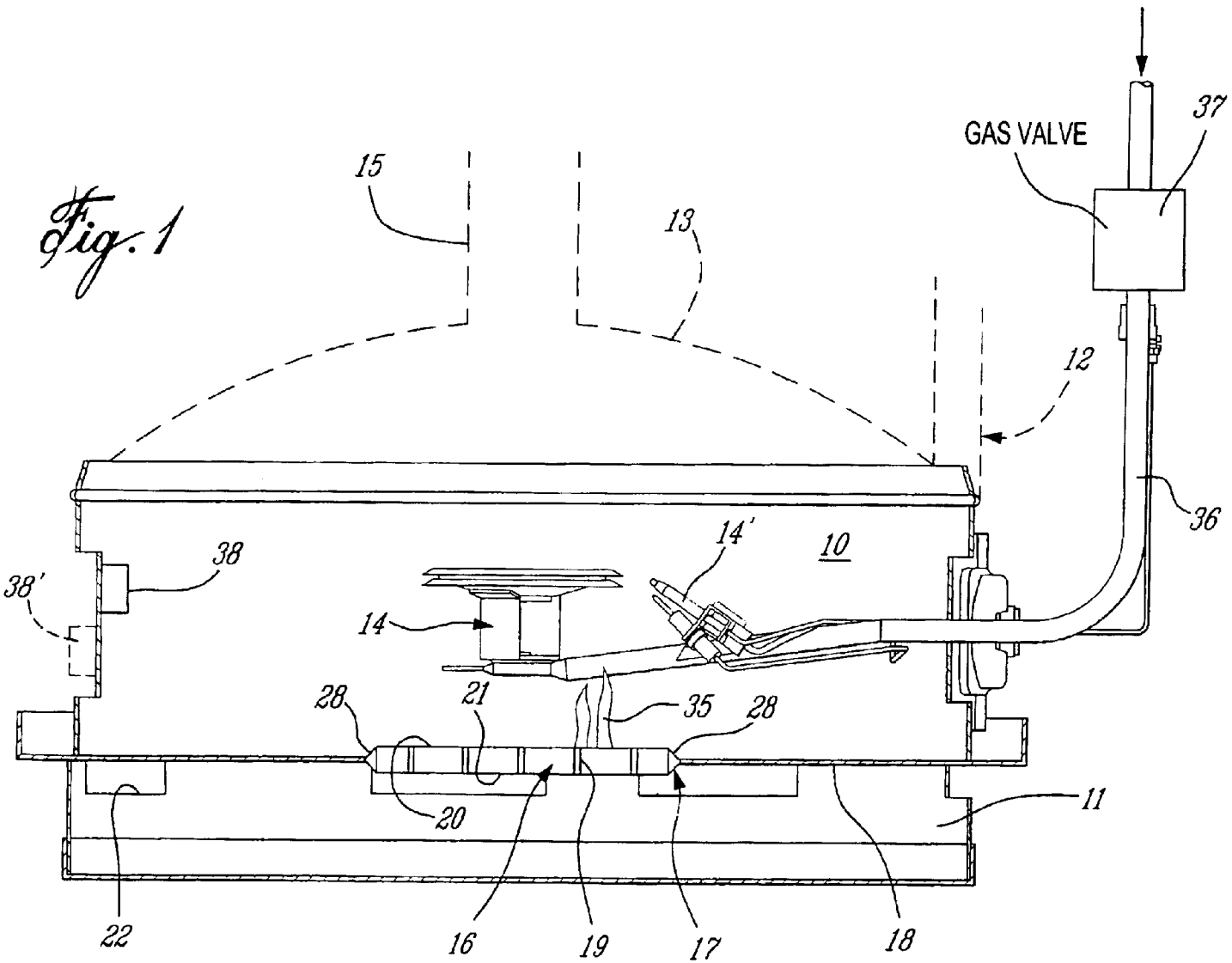
FIG. 1 is a simplified section view of a sealed combustion chamber of a gas-fired hot water heater illustrating the position and securement of the secondary burner of the present invention.

Referring now to the drawings and more particularly to FIG. 1 there is shown generally at 10 a sealed combustion chamber of a gas-fired hot water heater. The combustion chamber 10 is supported elevated by a support base 11 which supports a hot water heater having an inner casing shown partly in phantom line 12 and in which there is located an inner casing 13, the bottom wall thereof being illustrated also in phantom line and disposed above the main burner 14 which is usually supported central in the combustion chamber 10. A flue also shown in phantom lines at 15 extends through the inner casing 13 to exhaust the products of combustion from the sealed combustion chamber 10. This hot water heater construction is well known in the art.

The invention comprises a secondary gas burner perforated disc 16 supported entirely across an air inlet port 17 disposed centrally in a bottom wall 18 of the combustion chamber 10. As herein shown the secondary gas burner perforated metal disc 16 which is welded by a circumferential weld 28 all about the air inlet port 17 or on or under said bottom wall across the port 17. The disc can be a circular disc, a square disc or can have other suitable circumferential shapes. The disc is of uniform thickness and preferably within the range of from about ⅛ inch to ¾ inches in thickness. The perforated disc 16 is also provided with perforations or holes 19 throughout its inner surface 20 whereby a flame can be generated on the inner surface 20 of the secondary burner in the presence of flammable vapors and air entering the gas burner perforated disc 16 from the outer surface 21 thereof. As hereinshown this support base 11 is provided with air inlet openings 22 to permit ambient air in the immediate area of the hot water heater to be in communication with the secondary burner 16.

Figure 3:
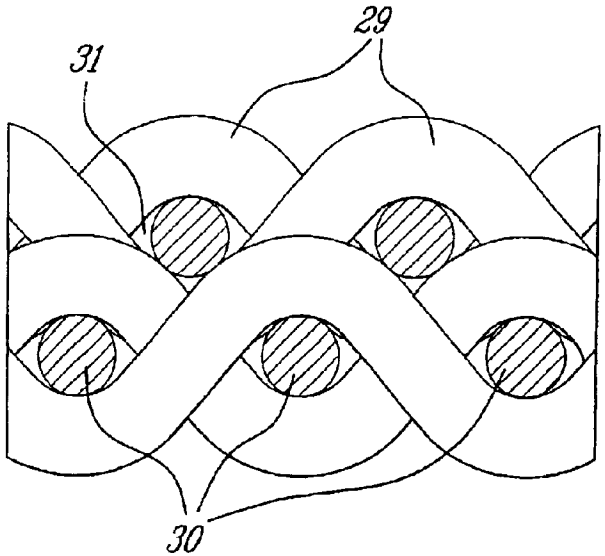
FIG. 3 is a fragmented side view illustrating two versions of the support base, one being a perforated base and the other one a base with air inlet openings in which a screen is removably secured.

As shown in FIG. 3 the support base 11 can be a perforated support base as illustrated at 11' having a plurality of holes 23 therein to admit air to the secondary burner 16. Any lint or dust in the vicinity of the support base will collect on the surface of the support base over these holes making it easy to clean by the use of a vacuum cleaning device. In another alternative embodiment of the support base 11' screens 24 are secured over the air inlet openings 22 by fasteners 25 or other fasteners permitting the screens to be removed and washed. However, these screens are also provided to collect lint and dust and to permit the removal thereof by the use of a vacuum cleaning device. It is desirable to shield the secondary gas burner outer surface 21 from such foreign materials which could clog up the perforations of the secondary burner making it difficult to clean by the domestic user of the hot water heater.

The secondary burner 16 can have a variety of constructions and wherein the disc may be fabricated as a perforated ceramic disc secured by a fastening bracket. The disc can also be made of metal which is perforated by special tooling with the metal selected to resist the high temperatures generated in the sealed combustion chamber 10. The metal disc is preferably constructed of stainless steel for longevity or other metals having similar properties.

Figure 2:
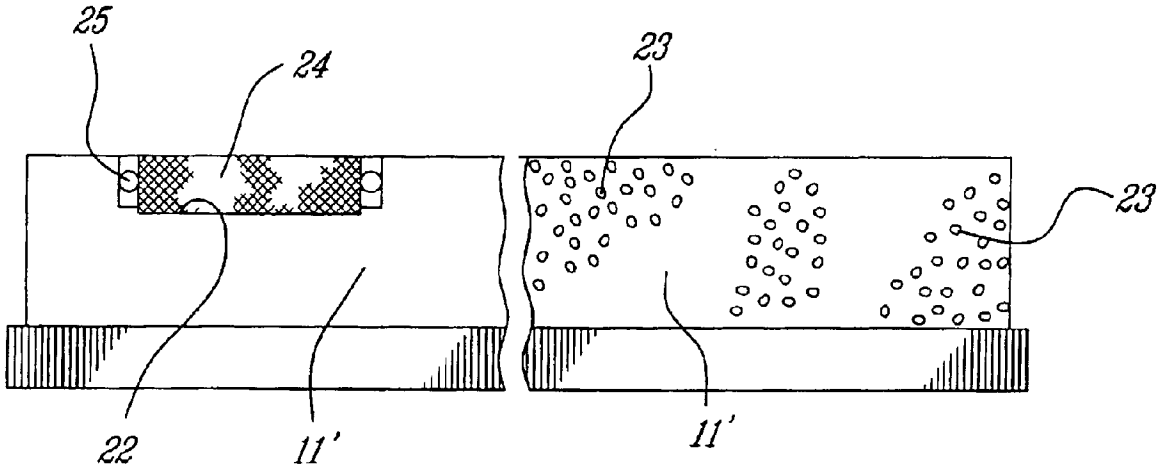
FIG. 2 is a fragmented perspective view illustrating the construction of a wire mesh gas burner disc.

As shown in FIG. 2 the secondary gas burner perforated disc 16 may also be constructed of a wire meshing having woven warp and weft metal wires 29 and 30 interwoven to produce a disc having sufficient thickness with the perforations being created by the interstices or openings 31 between the warp and weft metal strands.

It is important to note that the secondary gas burner perforated disc 16 is secured a predetermined distance under the primary burner 14 and concentrically aligned therewith in an unobstructed manner when flammable vapors enter the combustion chamber 10 through the secondary burner, the secondary burner 16 will be ignited by the primary burner 14 and generate flames, such as illustrated at 35, on the top surface 20 of the secondary burner. In the advent in which the flame from the primary burner and secondary burner increase the temperature in the combustion chamber 10 to a predetermined high temperature level, this will cause the gas supply in supply line 36 to be shut off by a gas valve 37. Such is described in my co-pending application referred to herein above.

In order to actuate the gas valve 37 there is provided a high temperature sensor 38 and which operates the valve 37 upon the detection of the high temperature limit in the combustion chamber by the sensor 38. The sensor 38 may be mounted inside the combustion chamber or on an outer side wall of the combustion chamber such as shown in phantom lines and illustrated by reference numeral 38'.

If the main burner 14 and its pilot 14' are ignited then the flame 35 of the secondary burner 16 will continue to burn the flammable vapors entering the combustion chamber. The hot combustion chamber and the flames 35 will continue to pull the flammable vapor mixed with air in the vicinity of the support base 11 with these vapors burning inside the combustion chamber.

It is within the ambient of the present invention to cover any obvious modifications of the preferred embodiment described herein, provided such modifications fall within the scope of the appended claims.

I claim:

1. A secondary burner for a sealed combustion chamber of a gas-fired hot water heater comprising a support base for supporting a hot water heater housing elevated from a floor surface, said sealed combustion chamber being supported over said base under an inner casing of said hot water heater adapted to contain water to be heated by a primary burner in said combustion chamber, an air inlet port in a bottom wall of said combustion chamber to supply combustion air to said primary burner, a secondary gas burner perforated disc secured entirely across said air inlet port in direct unobstructed communication with said primary burner, said secondary gas burner perforated disc having holes throughout said inner surface whereby to ignite on said inner surface thereof in the presence of flammable vapors and air entering said gas burner perforated disc from an outer surface thereof, said support base having air inlet openings to permit ambient air supply to said outer surface, said secondary gas burner perforated disc welded about or over said inlet port and disposed a predetermined distance under said primary burner and concentrically aligned therewith whereby flammable vapors entering said combustion chamber will be ignited by said primary burner, and cause a flame to burn on said inner surface of said secondary burner.

2. A secondary burner as claimed in claim 1, wherein said perforated disc is a metal disc which is perforated and capable of resisting to high temperatures generated in said sealed combustion chamber, said metal disc having a thickness in the range of from about ⅛ inch to about ¾ inch.

3. A secondary burner as claimed in claim 2, wherein said metal disc is a stainless steel disc.

4. A secondary burner as claimed in claim 1, wherein said perforated disc is a wire mesh disc of woven warp and weft metal wires capable of resisting to high temperatures generated in said sealed combustion chamber, said wire mesh disc having a thickness in the range of from about ⅛ inch to about +e,fra 34+ee inch, said perforations being created by interstices between said warp and weft strands.

5. A secondary burner as claimed in claim 1, wherein said air inlet openings are screened openings to permit external access to lint and dust collecting on said screened openings thereby substantially reducing the risk of lint and dust depositing on said outer surface of said gas burner perforated disc.

6. A secondary burner as claimed in claim 1, wherein said perforated disc is a ceramic perforated disc.

7. A secondary burner as claimed in claim 1, wherein said support base has a perforated circumferential side wall.

8. A secondary burner as claimed in claim 1, wherein there is further provided a high temperature sensor secured in relation to said sealed combustion chamber to sense temperature in said combustion chamber, and a gas valve operated by said sensor to cause said valve to cut a gas supply to said primary burner and a pilot associated therewith upon said sensor detecting a predetermined high temperature.

9. A secondary burner as claimed in claim 8, wherein said high temperature sensor is secured inside said sealed combustion chamber.

10. A secondary burner as claimed in claim 8, wherein said high temperature sensor is secured on an outer surface of a wall of said combustion chamber to sense the temperature of said wall as a function of the temperature inside said combustion chamber.

* * * * *